US008285192B2

(12) United States Patent
Okutsu et al.

(10) Patent No.: US 8,285,192 B2
(45) Date of Patent: Oct. 9, 2012

(54) IMAGE FORMING APPARATUS, CONTROL METHOD OF THE IMAGE FORMING APPARATUS, AND PRINTING MEDIUM CONVEYANCE APPARATUS

(75) Inventors: Akito Okutsu, Kanagawa (JP); Tsukasa Iwasaki, Kanagawa (JP); Takashi Nogami, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 529 days.

(21) Appl. No.: 12/554,105

(22) Filed: Sep. 4, 2009

(65) Prior Publication Data

US 2010/0119243 A1 May 13, 2010

(30) Foreign Application Priority Data

Nov. 12, 2008 (JP) ..... 2008-290201

(51) Int. Cl.
*G03G 15/00* (2006.01)

(52) U.S. Cl. ..... 399/394; 394/388

(58) Field of Classification Search ..... 399/394
See application file for complete search history.

(56) References Cited

U.S. PATENT DOCUMENTS 6,330,424 B1 * 12/2001 Chapman et al. ..... 399/394
6,356,735 B1 * 3/2002 Hozumi ..... 399/395
6,511,239 B1 * 1/2003 Kretschmann et al. ..... 400/579
7,003,258 B2 * 2/2006 Adachi et al. ..... 399/395
7,499,654 B2 * 3/2009 Mihara ..... 399/16
7,835,684 B2 * 11/2010 Heimbach et al. ..... 399/396
2002/0159783 A1 * 10/2002 Akashi et al. ..... 399/50

FOREIGN PATENT DOCUMENTS

| | | |
|---|---|---|
| JP | S62-185654 | 8/1987 |
| JP | 3256043 | 2/2002 |
| JP | 2007-001685 | 1/2007 |
| JP | 2007-106573 | 4/2007 |

* cited by examiner

*Primary Examiner* — Anthony Nguyen
(74) *Attorney, Agent, or Firm* — IPUSA, PLLC

(57) ABSTRACT

An image forming apparatus includes a conveyance part; a detecting part; a control part which prints image data on the printing medium based on a detecting signal from the detecting part; a masking part configured to perform a masking process on the detecting signal generated by the detecting part between when the printing medium starts being conveyed from the printing medium receiving part and when the printing medium passes through a designated section; a conveyance distance measuring part configured to measure a conveyance distance of the head end of the printing medium conveyed from a receiving position of the printing medium receiving part; a determining part configured to determine whether the printing medium stops in an uncertain position not detected by the detecting part when the conveyance part stops while the printing medium is being conveyed by the conveyance part; and a masking process section setting part configured to set.

10 Claims, 15 Drawing Sheets

IMAGE FORMING APPARATUS, CONTROL METHOD OF THE IMAGE FORMING APPARATUS, AND PRINTING MEDIUM CONVEYANCE APPARATUS

CROSS-REFERENCE TO RELATED APPLICATIONS

This patent application is based upon and claims the benefit of priority of Japanese Patent Application No. 2008-290201 filed on Nov. 12, 2008 the entire contents of which are incorporated herein by reference.

BACKGROUND OF THE INVENTION

1. Field of the Invention

The present invention generally relates to image forming apparatuses, control methods of the image forming apparatuses, and printing medium conveyance apparatuses. More specifically, the present invention relates to an image forming apparatus where printing is performed on a printing medium (sheet) conveyed at a conveyance path, a control method of the image forming apparatus, and a printing medium conveyance apparatus.

2. Description of the Related Art

Conventionally, a detecting part is provided in an image forming apparatus such as a copier or printer so that conveyance of a sheet as a printing medium is detected or a control timing of the apparatus is determined. For example, an optical sensor or a feeler sensor configured to detect arrival of the sheet, as the detecting part, is provided in the way of a sheet conveyance path. In addition, it is normal practice that the sheet is detected in order to 1) confirm if the sheet conveyed from a printing medium receiving part passes a designated position of the conveyance path, 2) determine a conveyance timing of a next sheet, 3) detect a sheet jam, or 4) confirm that there is no sheet just after the sheet is detected by the detecting part.

Furthermore, in the above-mentioned image forming apparatus, if noise is superimposed on a detecting signal from the detecting part, it cannot be determined which detecting signal is an original one detecting the sheet so that an error in detection may be made. In order to prevent such an operational error, a masking process is applied to a detecting signal until a designated time set in advance passes during which the sheet received in a printing medium receiving part (tray or cassette) is conveyed. By stopping the masking process just before the sheet arrives at the detecting position, the reliability and likelihood of the detecting signal is improved. A phenomenon where the noise is superimposed on the detecting signal can be found, for example, when foreign matter other than the sheet comes in contact with the feeler sensor provided as the detecting part or foreign matter such as a broken piece of the sheet is adhered on a lens of the optical sensor provided as the detecting part.

In the above-mentioned masking process, it is possible to prevent the error in detection due to the noise, by cancelling the detecting signal being output from the detecting part from when no sheet provided at the conveyance path is detected to when a designated time passes. See, for example, Japanese Laid-Open Patent Application Publication No. 3256043.

In addition, the detecting signal from the detecting part configured to detect the sheet is used as, for example, a trigger for performing a printing job or a timing signal for switching a clutch for starting motor driving or turning on or off motor torque.

In the meantime, in the image forming apparatus, an emergency stop may be required when the sheets are continuously conveyed and printing is performed. Emergency stop is required, for example, in a case where the sheet jams at the conveyance path, a head end of the sheet is bent, or a printer cover is opened. In the image forming apparatus, when a case among the above-mentioned cases requiring the emergency stop is detected, the emergency stop of the sheet conveyance is done by turning off the motor of the conveyance apparatus configured to convey the sheet or disengaging the clutch configured to transmit a rotational driving force of the motor to a sheet feeding roller.

However, in the image forming apparatus, if the masking process is performed after the sheet conveyance restarts in a case where the emergency stop is made as well as a normal printing step being performed, the printing likely restarts from a state where the sheet sticks out from the printing medium receiving part. Accordingly, even if the sheet arrives at the detecting position where the detecting part can detect the sheet, the sheet may not be detected because the masking process is not applied.

In addition, the detecting signal of the detecting part can be a trigger for starting a printing job relative to the sheet conveyed from the printing medium receiving part. Therefore, if the original detecting signal is disregarded due to the masking process, printing cannot be performed on the sheet so that only conveyance of the sheet may be performed.

SUMMARY OF THE INVENTION

Accordingly, embodiments of the present invention may provide a novel and useful image forming apparatus, a control method of the image forming apparatus, and a printing medium conveyance apparatus solving one or more of the problems discussed above.

One aspect of the present invention may be to provide an image forming apparatus, including a conveyance part configured to convey a printing medium received in a printing medium receiving part along a conveyance path; a detecting part configured to detect arrival of a head end of the printing medium at a detecting position of the conveyance path; a control part configured to print image data on the printing medium based on a detecting signal from the detecting part; a masking part configured to perform a masking process on the detecting signal generated by the detecting part between when the printing medium starts being conveyed from the printing medium receiving part and when the printing medium passes through a designated section; a conveyance distance measuring part configured to measure a conveyance distance of the head end of the printing medium conveyed from a receiving position of the printing medium receiving part; a determining part configured to determine whether the printing medium stops in an uncertain position not detected by the detecting part when the conveyance part stops while the printing medium is being conveyed by the conveyance part; and a masking process section setting part configured to set, in a case where it is determined by the determining part that the printing medium stops in the uncertain position, a range of a masking process section and/or a range of a non-masking process section, the masking process section being where the masking process of the conveyance path is performed based on a stopping position of the printing medium, the non-masking process section being where the masking process is not performed.

Another aspect of the present invention may be to provide a control method of an image forming apparatus, the image forming apparatus including a conveyance part configured to convey a printing medium received in a printing medium receiving part along a conveyance path; a detecting part configured to detect arrival of a head end of the printing medium at a designated distance of the conveyance path; and a control part configured to print image data on the printing medium based on a detecting signal from the detecting part; the control method including the steps of: performing a masking process on the detecting signal generated by the detecting part between when the printing medium starts being conveyed from the printing medium receiving part and when the printing medium passes through a designated section; measuring a conveyance distance of the head end of the printing medium conveyed from a receiving position of the printing medium receiving part; determining whether the printing medium stops in an uncertain position not detected by the detecting part when the conveyance part stops while the printing medium is being conveyed by the conveyance part; and setting, in a case where it is determined by the determining part that the printing medium stops in the uncertain position, a range of a masking process section and/or a range of a non-masking process section, the masking process section being where the masking process of the conveyance path is performed based on a stopping position of the printing medium, the non-masking process section being where the masking process is not performed.

Another aspect of the present invention may be to provide a printing medium conveyance apparatus, including a conveyance part configured to convey a printing medium received in a printing medium receiving part along a conveyance path; a detecting part configured to detect arrival of a head end of the printing medium at a designated distance of the conveyance path; a masking part configured to perform a masking process on a detecting signal generated by the detecting part between when the printing medium starts being conveyed from the printing medium receiving part and when the printing medium passes through a designated section; a conveyance distance measuring part configured to measure a conveyance distance of the head end of the printing medium conveyed from a receiving position of the printing medium receiving part; a determining part configured to determine whether the printing medium stops in an uncertain position not detected by the detecting part when the conveyance part stops while the printing medium is being conveyed by the conveyance part; and a masking process section setting part configured to set, in a case where it is determined by the determining part that the printing medium stops in the uncertain position, a range of a masking process section and/or a range of a non-masking process section, the masking process section being where the masking process of the conveyance path is performed based on a stopping position of the printing medium, the non-masking process section being where the masking process is not performed.

According to the embodiments of the present invention, it is possible to reliably detect the printing medium even if the printing medium stops at the conveyance path, so that a printing process can be reliably performed.

Additional objects and advantages of the embodiments will be set forth in part in the description which follows, and in part will become obvious from the description, or may be learned by practice of the invention. The object and advantages of the invention will be realized and attained by means of the elements and combinations particularly pointed out in the appended claims.

It is to be understood that both the foregoing general description and the following detailed description are exemplary and explanatory only and are not restrictive of the invention as claimed.

DETAILED DESCRIPTION OF THE PREFERRED EMBODIMENTS

A description is given below, with reference to FIG. 1 through FIG. 14 of embodiments of the present invention.

Figure 1:
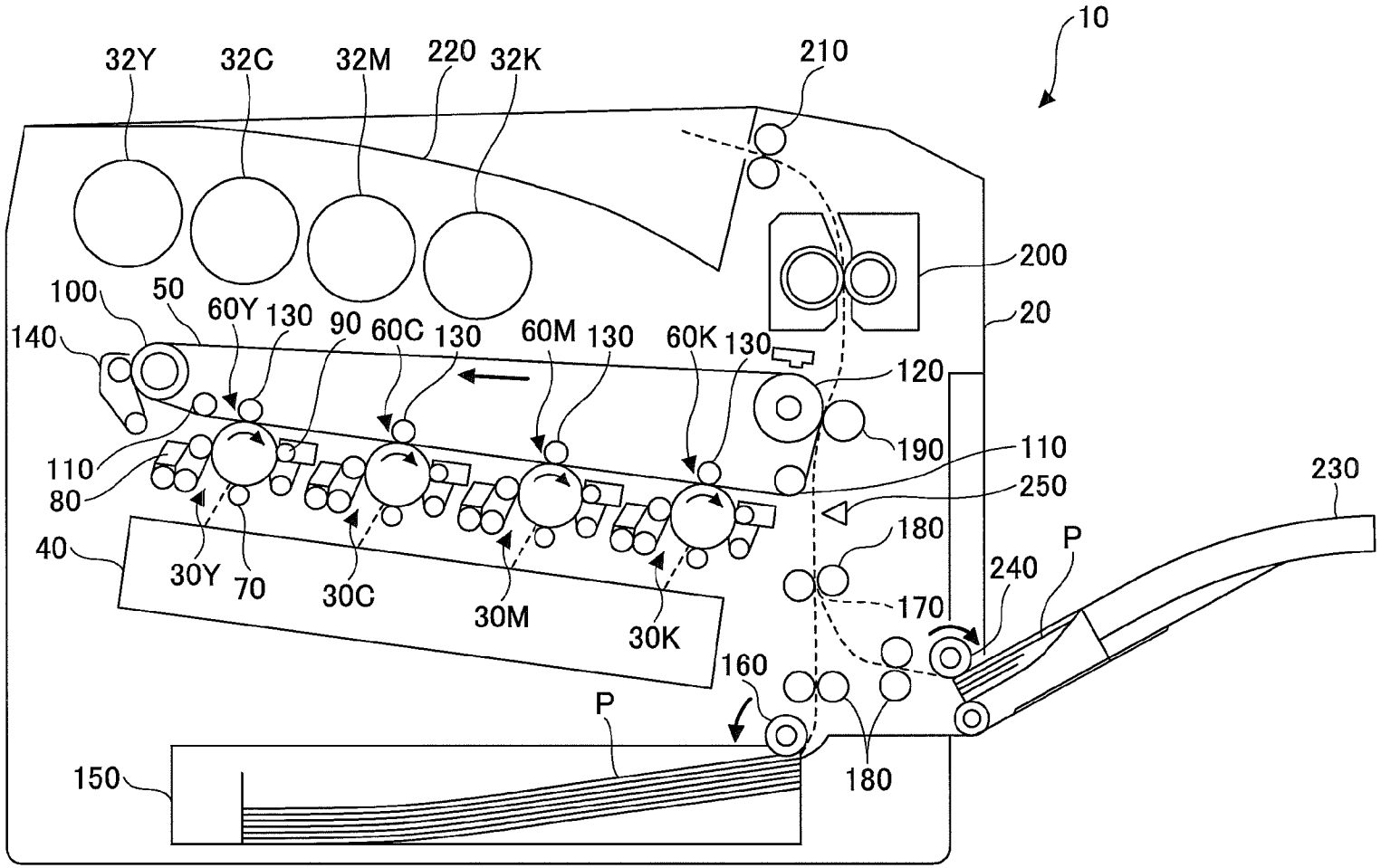
FIG. 1 is a vertical cross-sectional view showing a schematic structure of an image forming apparatus of an embodiment of the present invention.

FIG. 1 is a vertical cross-sectional view showing a schematic structure of an image forming apparatus of an embodiment of the present invention. As shown in FIG. 1, four printer engines 30 (30Y, 30C, 30M, 30K), an optical writing device 40, an intermediate transferring belt 50, and other parts are provided in the substantially center part of an inside of a main body case 20 of a printer 10 as the image forming apparatus of the embodiment of the present invention. The optical writing device 40 emits light beams so that photosensitive bodies are irradiated by scanning lines of the corresponding light beams. Each of the printer engines 30 (30Y, 30C, 30M, 30K) forms a toner image and has essentially the same structure. In the printer engines 30 (30Y, 30C, 30M, 30K), inks having different colors supplied from toner bottles 32Y, 32C, 32M, 32K provided above the printer engines 30 (30Y, 30C, 30M, 30K) are used so that toner images having different colors are formed. Letters "Y", "C", "M", and "K" of the printer engines 30Y, 30C, 30M, and 30K and components of the printer engines 30Y, 30C, 30M, and 30K which are discussed in this specification and illustrated in drawings indicate colors of yellow, cyan, magenta, and black, respectively. These letters are omitted as necessary.

Four printer engines 30 (30Y, 30C, 30M, 30K) have the same mechanical structures. Each of the printer engines 30 (30Y, 30C, 30M, 30K) includes a photosensitive body 60 (60Y, 60C, 60M, 60K), an electrically charging part 70, a developing part 80, a cleaning part 90, and other parts. The photosensitive body 60 (60Y, 60C, 60M, 60K) is rotationally driven in a direction indicated by an arrow. The electrically charging part 70 is provided in the periphery of the photosensitive body 60 (60Y, 60C, 60M, 60K).

Each of the photosensitive bodies 60 (60Y, 60C, 60M, 60K) has a cylindrical-shaped configuration and is rotationally driven by a driving motor (not shown in FIG. 1). A photosensitive layer is provided on an external circumferential surface of the photosensitive body 60 (60Y, 60C, 60M, 60K). The external circumferential surface of the photosensitive body 60 (60Y, 60C, 60M, 60K) is irradiated by a light beam outgoing from the optical writing device 40, so that an electrostatic latent image corresponding to image data is written on the external circumferential surface of the photosensitive body 60 (60Y, 60C, 60M, 60K). The electrically charging part 70, the developing part 80, and the cleaning part 90 are individually provided at each of the photosensitive bodies 60 (60Y, 60C, 60M, 60K).

The electrically charging part 70 is, for example, an electrically charging roller member having a roller-shaped configuration. An electrically charging bias voltage is supplied from an electric power device (not shown in FIG. 1) to the electrically charging part 70 and thereby the external circumferential surface of the photosensitive body 60 is electrically charged.

The developing part 80 is configured to supply toner onto the photosensitive body 60 (60Y, 60C, 60M, 60K). The supplied toner is adhered to the electrostatic latent image written on the external circumferential surface of the photosensitive body 60 so that the electrostatic latent image on the photosensitive body 60 is visualized as a toner image.

The cleaning part 90 is configured to remove residual toner. The residual toner is adhered on the external circumferential surface of the photosensitive body 60 after the toner image formed on the photosensitive body 60 is transferred to the intermediate transferring belt 50.

The intermediate transferring belt 50 is made of a resin film or rubber as a basic material. The intermediate transferring belt 50 has a loop-shaped configuration. The toner image formed on the photosensitive body 60 is transferred to the intermediate transferring belt 50. The intermediate transferring belt 50 is, by rollers 100, 110, and 120, supported and rotationally driven in a direction indicated by an arrow. Four transferring rollers 130 are arranged at an internal circumferential surface side of the loop of the intermediate transferring belt 50. The transferring roller 130 is configured to transfer the toner image on the photosensitive body 60 to the intermediate transferring belt 50. The toner images formed on the photosensitive bodies 60 are transferred in turn and superposed on the intermediate transferring belt 50 so that a color toner image is carried on the intermediate transferring belt 50. A cleaning part 140 is provided at an external circumferential surface side of the loop of the intermediate transferring belt 50. The cleaning part 140 is configured to remove paper powder or the residual toner adhered on the external circumferential surface of the intermediate transferring belt 50.

A sheet feeding tray 150 (first printing medium receiving part) is provided under the printer engines 30Y, 30C, 30M and 30K and the optical writing device 40 in the main body case 20. Recording media (printing sheets) P are stacked and stored in the sheet feeding tray 150. The recording media P stacked and stored in the sheet feeding tray 150 are separated and fed in turn as the recording medium situated uppermost by the sheet feeding roller 160.

A conveyance path 170 (shown by a dotted line in FIG. 1) is formed in the main body case 20. The printing medium P separated and fed from the sheet feeding tray 150 is conveyed at the conveyance path 170. Resist rollers 180, transferring rollers 190, a fixing part 200, sheet discharge rollers 210, and other are provided on the conveyance path 170.

The resist rollers 180 are rotationally and intermittently driven at a designated timing. By rotating the resist rollers 180 intermittently, the printing medium P conveyed to and stopped at a position of the resist rollers 180 is sent to a transferring position sandwiched by the intermediate transferring belt 50 and the transferring roller 190. While the printing medium P is being passed through the transferring position, the toner image on the intermediate transferring belt 50 is transferred onto the printing medium P.

The fixing part 200 is configured to apply heat and pressure to the printing medium P where the toner image has been transferred so that the toner is melted and the toner image is fixed to the printing medium P. The printing medium which has been passed through the fixing part 200 so that the toner image has been fixed is discharged to a sheet discharge tray 220 formed at an upper surface part of the main body case 20.

A sheet feeding tray (second printing medium receiving part) 230 which can be opened and closed is provided at a right side surface of the main body case 20. For example, a printing medium P having a size different from the printing medium P received in the sheet feeding tray 150 is received in the sheet feeding tray 230. A sheet feeding roller 240 is provided at a sheet feeding side of the sheet feeding tray 230. The sheet feeding roller. 24 is pressed against the printing medium P.

The recording media P received in the sheet feeding tray 150 (230) are taken out one by one as the printing medium situated uppermost by rotating the sheet feeding rollers 160 (240) in directions indicated by arrows in FIG. 1 so as to be conveyed to the conveyance path 170. A conveyance position detecting sensor 250 is, as a detecting part, provided in the vicinity of the conveyance path 170. The detecting sensor 250 is configured to detect the arrival of the head ends of the printing media P supplied from the sheet feeding tray 150 (230) to a detecting position separated from tray sheet feeding openings at designated distances.

The conveyance position detecting sensor 250 may be, for example, a contact type feeler sensor configured to come in contact with the head end of the printing medium P and output a detecting signal, a reflecting type optical sensor configured to irradiate a light and output a detecting signal when receiving a reflection light reflected by the printing medium P, or an optical sensor configured to output a detecting signal based on that the light being blocked when the printing medium P passes through a gap between a light emitting element and a light receiving element facing each other, one at each side of the conveyance path 170.

Figure 2:
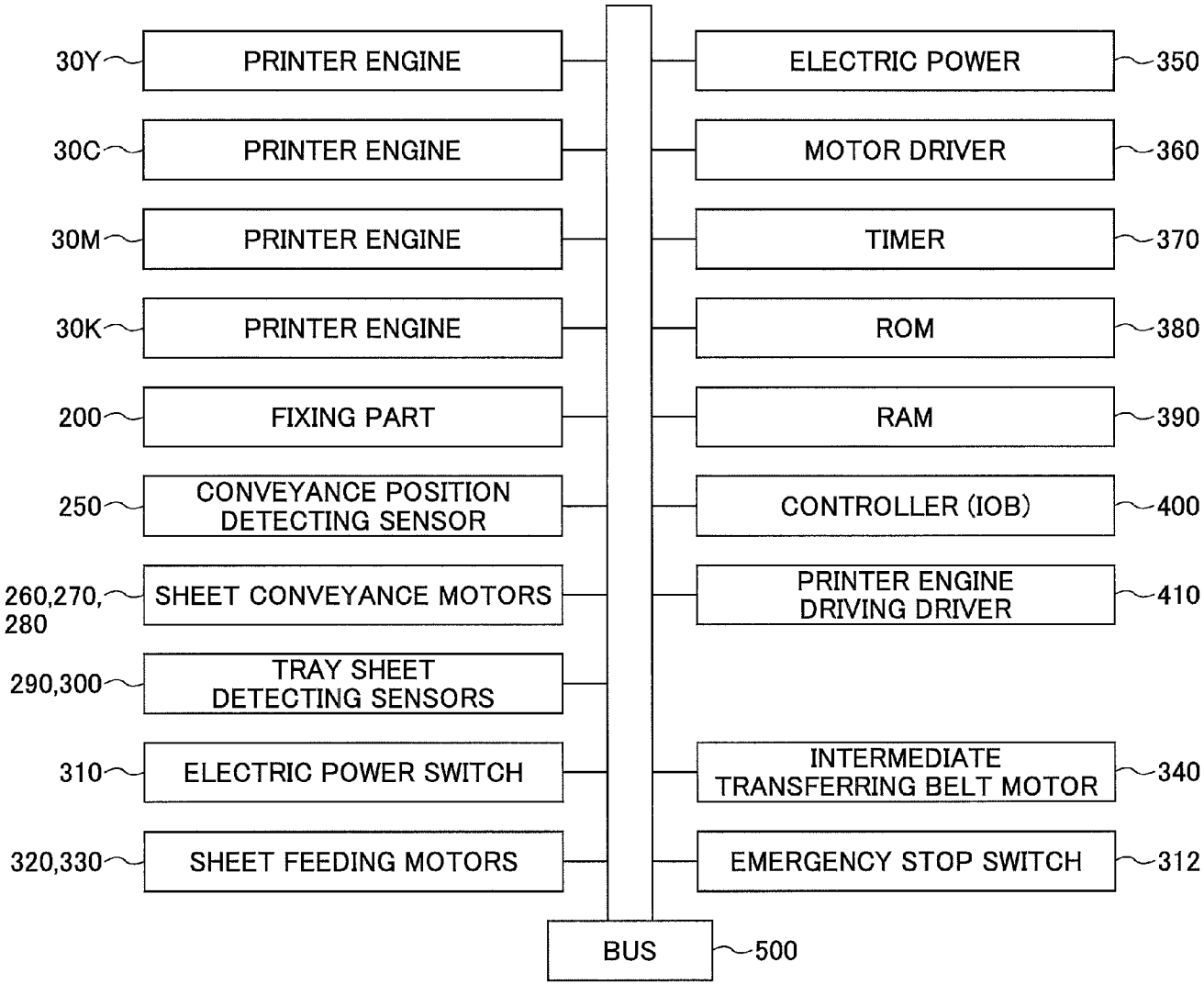
FIG. 2 is a block diagram showing parts forming the image forming apparatus of the embodiment of the present invention.

FIG. 2 is a block diagram showing parts forming the image forming apparatus of the embodiment of the present invention. As shown in FIG. 2, the image forming apparatus includes the printer engines 30Y, 30C, 30M, and 30K, the fixing part 200, the conveyance position detecting sensor 250, sheet conveyance motors 260, 270, and 280, tray sheet detecting sensors 290 and 300, an electric power switch 310, an emergency stop switch 312, sheet feeding motors 320 and 330, an intermediate transferring belt motor 340, an electric power supply unit 350, a motor driver 360, a timer 370, a ROM (Read-Only-Memory) 380, a RAM (Random-Access-Memory) 390, a controller (controlling part) 400, and a printer engine driving driver 410. These are connected to each other via a bus 500. The controller 400 reads various kinds of control programs stored in the ROM 380 and controls driving of the motor driver 360 and the printer engine driving driver 410. The controller 400 controls each of the printer engines 30Y, 30C, 30M, and 30K; the fixing part 200; the sheet conveyance motors 260, 270, and 280; and the sheet feeding motors 320 and 330 so that the image data are printed (developed, transferred, fixed) on the printing medium P while the printing medium P is conveyed along the conveyance path 170.

Rotation directions, rotation torques, and rotation times of the sheet conveyance motors 260, 270, and 280 are controlled so that the resist rollers 180, the transferring roller 190, and the sheet discharge rollers 210 are rotationally driven based on the conveyance timing of the printing medium P. The sheet feeding motors 320 and 330 are driving parts configured to rotationally drive the sheet feeding rollers 160 and 240 in order to take out the printing media P received in the sheet feeding trays 150 and 230. The sheet feeding motors 320 and 330 are rotationally driven so that the printing medium P is supplied from one of the trays corresponding to sheet designation data being set with a printing job.

The tray sheet detecting sensors 290 and 300 detect the existence of the printing media P received in the sheet feeding trays 150 and 230. For example, when all of the printing media P in the sheet feeding trays 150 and 230 are conveyed, the tray sheet detecting sensors 290 and 300 output signals indicating that there is no printing medium P.

The emergency stop switch 312 is turned off so that electric power to all of the motors is blocked and the printer 10 stops working, for example, in a case where the printing medium P being conveyed at the conveyance path 170 is jammed during the printing; in a case where a cover provided at the side surface of the printer 10 or the sheet feeding tray 150 or 230 is opened; and in a case where it is detected that a residual amount of the printing media P of the tray designated by the tray sheet detecting sensors 290 and 300 becomes zero.

The following programs are used as the above-mentioned control programs. One is a control program for controlling the printer engines 30Y, 30C, 30M, and 30K, and the fixing part 200 so that printing relative to the printing medium is performed based on the printing job. Another is a control program for individually controlling the sheet conveyance motors 260, 270, and 280; the sheet feeding motors 320 and 330; and the intermediate transferring belt motor 340 based on the printing control.

A masking part, a conveyance distance measuring part, a determining part, and a masking process section setting part are stored in the ROM 380. The masking part is a control program whereby a masking process is applied to a detecting signal generated by the detecting part until a designated time passes after the conveyance from the sheet feeding tray 150 (230) starts. The conveyance distance measuring part is a control program whereby a conveyance distance of a head end of the printing medium P conveyed from receiving positions of the sheet feeding trays 150 (230) is measured. The determining part is a control program whereby whether the printing medium P stops in an uncertain position not detected by the conveyance position detecting sensor 250 (detecting part) in a case where the printing medium P stops in a process for conveying the printing medium P is determined. The masking process section setting part is a control program whereby a masking process section or a non-masking process section is set in a case where it is determined that the printing medium P stops in an uncertain position. Here, the masking process section is where the masking process of the conveyance path is performed based on the stopping position of the printing medium P. The non-masking process section is where the masking process is not performed.

Figure 3:
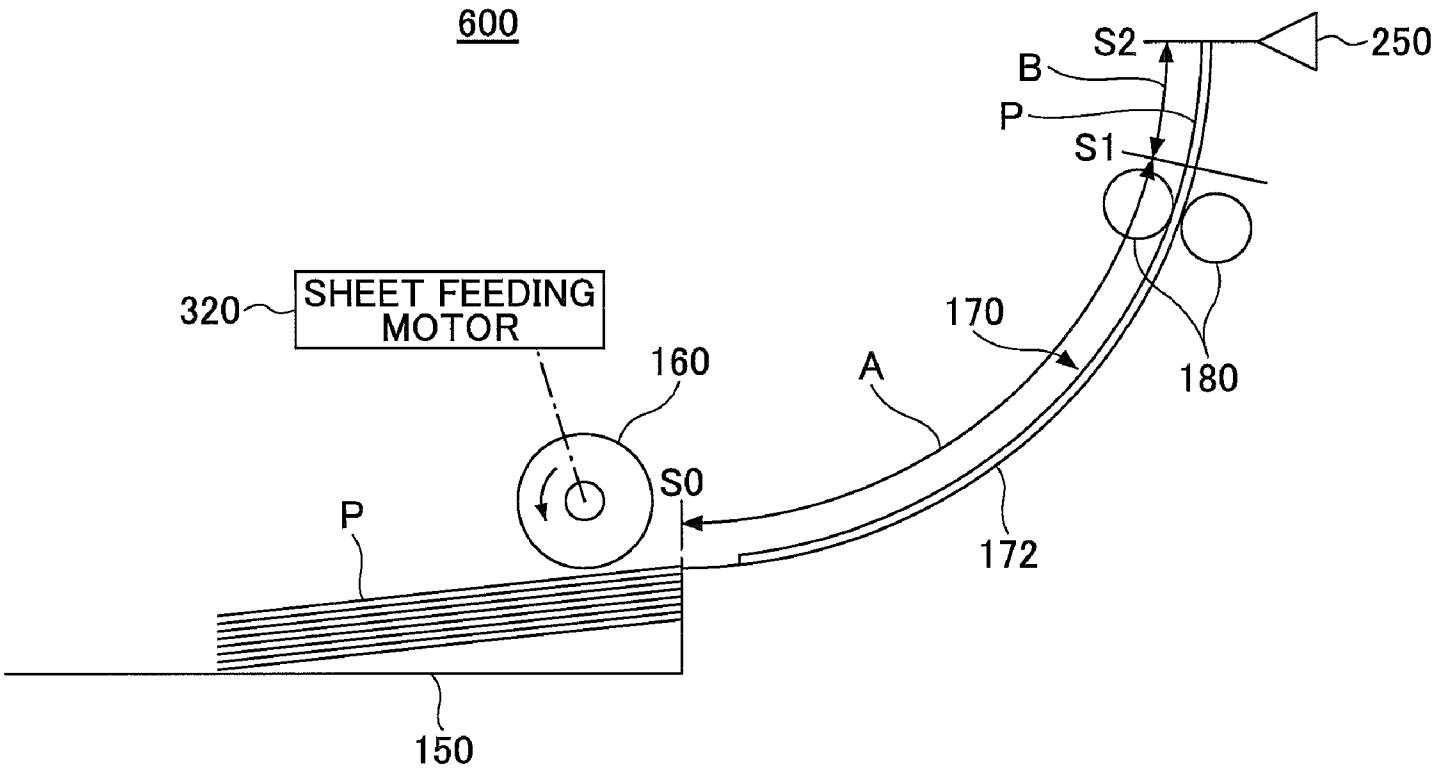
FIG. 3 is a view showing a schematic structure of a conveyance mechanism 600 configured to convey a printing medium P from a sheet feeding tray 150 to a conveyance path 170.

FIG. 3 is a view showing a schematic structure of a conveyance mechanism 600 configured to convey a printing medium P from a sheet feeding tray 150 to a conveyance path 170. As shown in FIG. 3, the conveyance mechanism 600 configured to convey the printing medium P received in the sheet feeding tray 150 forms a printing medium conveyance apparatus. The conveyance mechanism 600 includes a sheet feeding roller 160, a guide member 172, resist rollers 180, and a conveyance position detecting sensor 250. The sheet feeding roller 160 is pressed at a sheet feeding opening S0 of the sheet feeding tray 150 against the printing medium P situated uppermost. The guide member 172 is configured to guide, along the conveyance path 170, the printing medium P conveyed from the sheet feeding tray 150. The resist rollers 180 are configured to move the printing medium P at the conveyance path 170 in the conveyance direction. The conveyance position detecting sensor 250 is configured to detect arrival of the head end of the printing medium P at the detecting position S2.

In addition, each of the printing media P received in the sheet feeding tray 150 is stacked so that the head end in the conveyance direction is consistent with the position of the sheet feeding opening S0 of the sheet feeding tray 150. Because of this, a starting position of the conveyance of the printing medium P to be conveyed from the sheet feeding tray 150 by rotation of the sheet feeding roller 160 is the position of the sheet opening S0.

The sheet feeding roller 160 is rotated by the sheet feeding motor 320. The sheet feeding roller 160 conveys the printing media P, one by one as the printing medium P situated uppermost when the printing job is performed. For example, in a case where a stepping motor is used as the sheet feeding motor 320, a rotating amount (rotating angle) of the sheet feeding roller 160 can be determined based on a motor axis rotating angle and it is possible to calculate the conveyance distance of the printing medium P based on the relationship between the diameter D and the rotating amount N of the sheet feeding roller 160. In other words, the controller 400 calculates an external circumference ($2\pi \cdot D$) from the diameter D of the sheet feeding roller 160 and stores the conveyance distance calculated by multiplying the length of the external circumference and the rotating amount N in the RAM 390, so that the conveyance distance of the printing medium P can always be measured (conveyance distance measuring part).

In the conveyance path 170 where the printing medium P is conveyed, the section A where the head end of the printing medium P is situated extending from the sheet feeding opening S0 to a masking end position S1 of the sheet feeding tray 150 is a masking process section where the masking process is performed on the conveyance position detecting sensor 250. In this embodiment, the masking process is applied for the distance or the time period when the head end of the printing medium P moves in the section A from the sheet feeding opening S0 of the sheet feeding tray 150 to the masking end position S1. When the head end of the printing medium P reaches the masking end position S1, the masking process is ended. A section B where the head end of the printing medium P travels from the masking end position S1 to the detecting position S2 is a non-masking process section where the masking process is cancelled. In the section B, the conveyance position of the printing medium P is determined based on the detecting signal of the conveyance position detecting sensor 250 so that the printing job to the printing medium P can be performed. The range of the section B is set equal to a predetermined fixing distance Ly so that the masking process is not performed during normal printing.

Furthermore, in a case where the emergency stop switch 312 of the printer 10 is turned on in the printing state of an emergency stop, the controller 400 reads the conveyance distance of the printing medium P stored in the RAM 390 and determines whether the printing medium P stops in an uncertain position not detected by the conveyance position detecting sensor 250 (determining part). In a case where the head end of the printing medium P stops in the uncertain position at the time of the emergency stop, the controller 400 sets, based on the stop position (distance from the tray sheet feeding opening S0) of the head end of the printing medium P, the range of the masking process section (section A) where the masking process is performed along the conveyance path or the non-masking process section (section B) where the masking process is not performed (masking process section setting part). As a result of this, when the head end of the printing medium P passes through the section B at the time of restart of printing, the masking process is cancelled.

Although a case where the printing medium P is conveyed from the sheet feeding tray 150 received in the main body of the printer 10 is illustrated in FIG. 3, a conveyance mechanism of another sheet feeding tray 230 is the same as the conveyance mechanism 600. Accordingly, explanation of the conveyance mechanism 600 is omitted.

Figure 4:
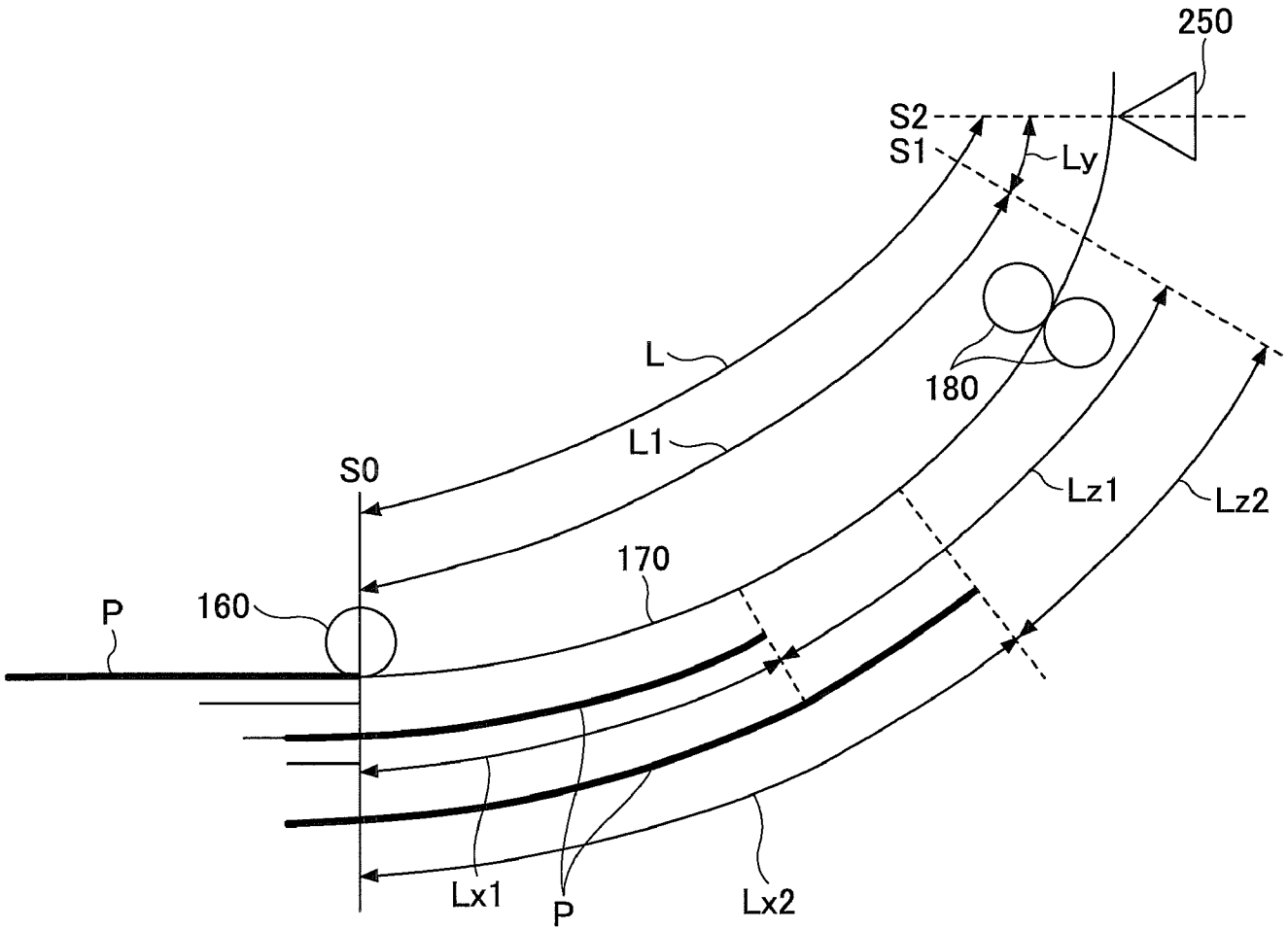
FIG. 4 is a schematic view of a masking process section and a non-masking process section being set when the printing medium P is conveyed along a conveyance path 170.

Here, setting of the masking process section and the non-masking process section, which are set when the printing medium P is conveyed along the conveyance path 170, is discussed with reference to FIG. 4. As shown in FIG. 4, the mask processing section setting part calculates, in a case where the printer 10 stops in emergency, an uncertain distance Lx from the sheet feeding tray 150 (230) to the head end of the printing medium P. The mask processing section setting part calculates a variable masking distance Lz by subtracting a fixed distance Ly determined based on the uncertain distance Lx and the detecting position S2 from the distance L between the sheet feeding trays 150 (230) and the detecting position S2. A value calculated by dividing the variable masking distance Lz by the conveyance speed v of the conveyance part is stored in the RAM (storage part) 390 as a setting value of the setting time. The variable masking distance Lz is stored in the RAM (storage part) 390 as a setting distance of the setting time.

The mask processing section setting part makes the uncertain distance Lx equal zero in a case where the head end of the printing medium P is sticking out of the sheet feeding tray 150 (230) at the time when the printer 10 stops in emergency. The mask processing section setting part stores a value calculated by the formula of the variable masking distance Lz (=the distance L−the fixed distance Ly)/the conveyance speed v as the setting time. The variable masking distance Lz is stored in the RAM (storage part) 390 as a setting distance of the setting time.

Here, a main control process performed by the controller 400 is discussed with reference to the flowchart shown in FIG. 5. In the flowchart, the printing medium P is described as a sheet.

Figure 5A:
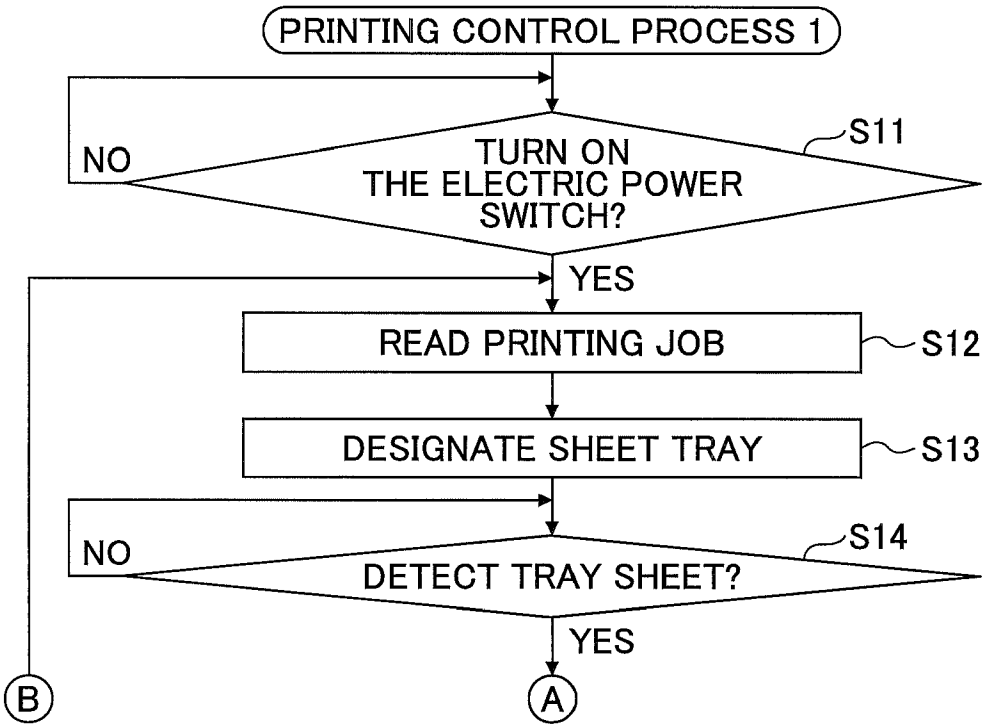
FIG. 5 is a flowchart for explaining a main control process performed by a controller 400.
Figure 5B:
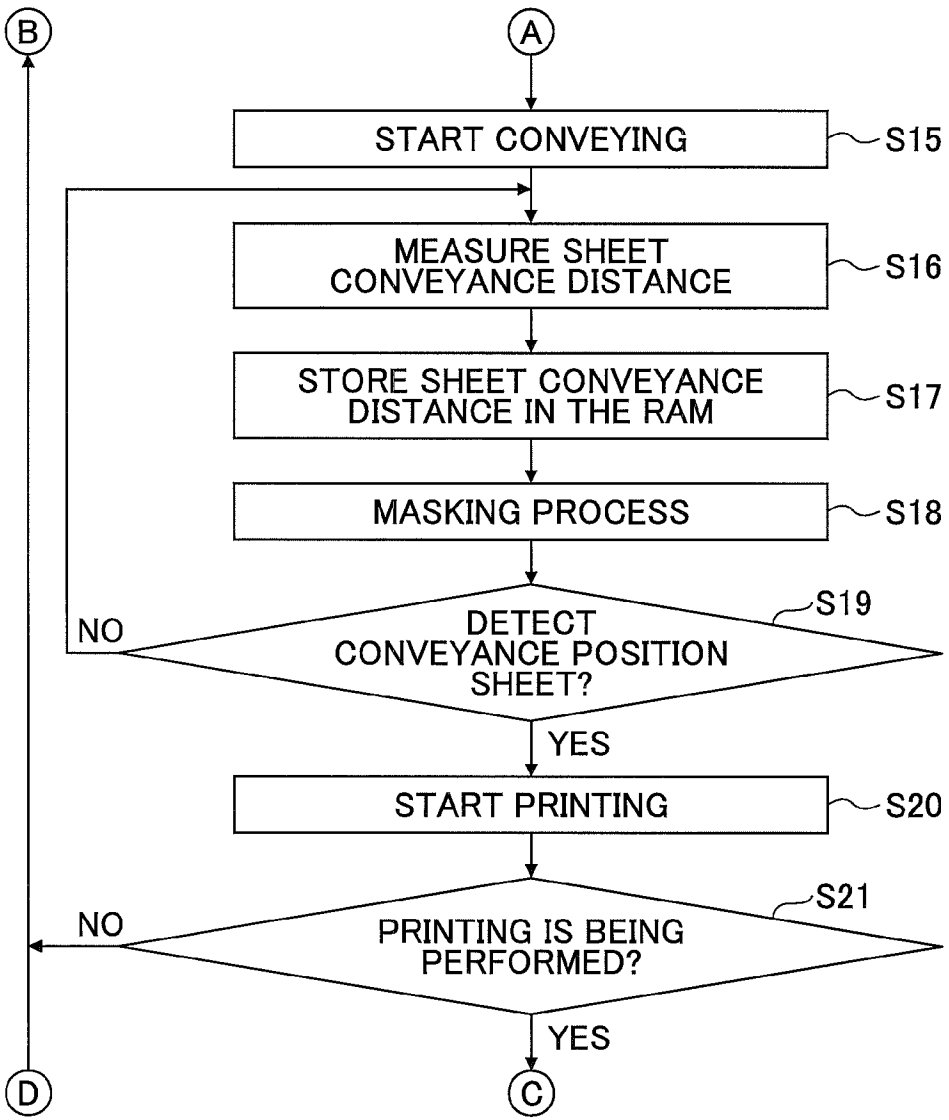
Figure 5C:
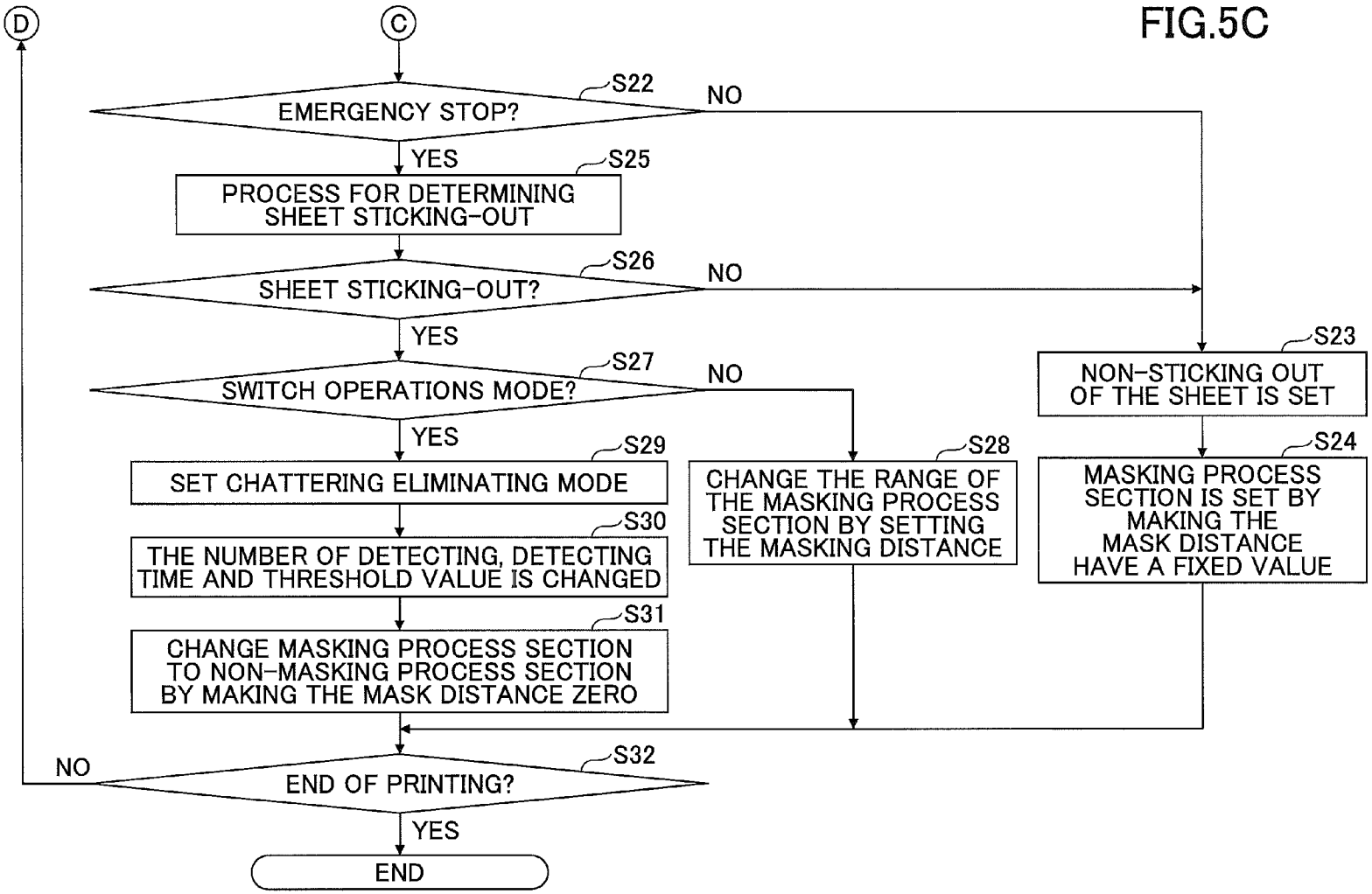

As shown in FIG. 5, when the electric power switch 310 is turned on in step S11 (YES in step S11), the process goes to step S12. In step S12, the printing job set and registered in the RAM 390 of the printer 10 is read. Next, in step S13, a tray is designated where the printing medium P corresponding to the sheet data included in the printing job is received. In this embodiment, two sheet trays 150 and 230 are provided. Either the sheet received in the sheet feeding tray 150 or the sheet received in the sheet feeding tray 230 can be used. For example, an A4 size or B5 size can be designated as a size of the printing medium P.

In step S14, based on a detecting signal of the tray sheet detecting sensor 290 or 300 corresponding to the designated tray (the sheet feeding tray 150 or the sheet feeding tray 230), whether the printing document P is in the tray 150 or 230 is determined. If the printing document P exists in the designated tray (the sheet feeding tray 150 or the sheet feeding tray 230), namely YES in the step S14, the process goes to step S15. In step S15, any of the sheet conveyance motors 260, 270 and 280 and the sheet feeding motors 320 and 330 are driven so that the printing media P received in the tray start being conveyed to the conveyance path 170 one by one.

In step S16, based on the external circumference and the rotating amount (rotating angle) of the sheet feeding rollers 160 and 240 rotationally driven by the sheet feeding motors 320 and 330, the conveyance distance Lx of the printing medium P conveyed from the tray (sticking out distance from the tray, see FIG. 4) is measured (conveyance distance measuring part). Next, the process goes to step S17 so that the calculated conveyance distance Lx of the printing medium P is stored in the RAM 390. As shown in FIG. 4, the conveyance distance of the printing medium P is changed to Lx1, Lx2, . . . as time passes. Therefore, in this embodiment, the conveyance distance Lx is overwritten in the RAM 390 repeatedly so that the conveyance distance Lx stored in the RAM 390 is renewed in real time.

In step S18, a masking process corresponds to a preset distance (masking part). In this masking, the detecting signal of the conveyance position detecting sensor 250 which is output while the printing medium P is passed through a certain distance L1 is disregarded. Here, the distance L1 is a distance where the preset fixing distance Ly is subtracted from the distance L along the conveyance path 170 from the sheet feeding opening S0 of the tray to the detecting position S2 detected by the conveyance position detecting sensor 250. In the section B shown in FIG. 3 corresponding to the fixed distance Ly, the masking process is not performed. The certain distance L1 is set as a set distance.

Next, the process goes to step S19. In step S19, the detecting signal of the conveyance position detecting sensor 250 is read so that it is detected whether the head end of the printing medium P arrives at the detecting position S2. In step S19, when the position detecting sensor 250 does not output the detecting signal detecting the printing medium P (NO in step S19), the process returns to step S16 so that the processes of step S16 through step 19 are repeated. In addition, in step S19, when the position detecting sensor 250 outputs the detecting signal detecting the printing medium P (YES in step S19), the process goes to step S20 so that printing of the conveyed printing medium P starts. In this embodiment, by the printer engines 30Y, 30C, 30M, and 30K and the fixing part 200, the image data having been set by the printing job are printed on the printing medium P.

In step S21, whether printing is being performed by the printing job is determined. In step S21, when the printing by the printing job ends (NO in step S21), the process returns to step S12 so that the processes after step S12 are repeated. In step S21, when the printing by the printing job is being performed (YES in step S21), the process goes to step S22 so that whether there is an emergency stop is determined.

In step S22, if there is no emergency stop (NO in step S22), the process goes to step S23 so that non-sticking out of the sheet is set. In the next step S24, by setting the masking distance (set distance for the masking process) to have a fixed value, the masking process section (section A) is set. This fixed value is the certain distance L1 (see FIG. 4) discussed above.

After this, the process goes to step S32 so that whether the printing has ended is determined. When the printing has not ended, the process returns to step S12 so that the processes after step S12 are repeated.

In addition, in a case where the emergency stop switch 31 is turned off and electric power to all motors is cut so that the emergency stop state exists in step S22 (YES in step S22), the process goes to step S25 so that a process for determining sheet sticking-out (determining part) is performed. Details of the process are discussed below with reference to FIG. 6. The emergency stop is made, for example, in a case where the printing medium P being conveyed at the conveyance path 170 is jammed during the printing; in a case where a cover provided at the side surface of the printer 10 or the sheet feeding tray 150 or 230 is opened; and in a case where it is detected that a residual amount of the printing medium P of the tray designated by the tray sheet detecting sensors 290 and 300 becomes zero.

In step S26, whether the result of the process for determining sheet sticking-out shows there is sheet sticking-out is determined. In step S26, if it is determined that the result of the process for determining sheet sticking-out shows there is no sheet sticking-out (NO in step S26), since the printing medium P situated uppermost is received in the sheet feeding tray 150 or 230, the process goes to step S23 so that the processes of step S23 and S24 are performed. By making the masking distance (the distance being set for the masking process) have a fixed value, the range of the masking process section (section A) is set.

In step S26, if it is determined that the result of the process for determining sheet sticking-out shows there is sheet sticking-out (YES in step S26), the process goes to step S27 so that it is determined whether the operations mode switch is designated (operations mode switching part). This operations mode switch may be preset, automatically set depending on a state, or set by an input operation with, for example, an operations mode setting switch.

In step S27, if the operations mode switch is not designated (NO in step S27), the process goes to step S28. In step S28, a masking process section setting process (discussed below) is performed so that the range of the masking process section (section A) is set (masking process section setting part). In other words, the mask distance (uncertain distance Lx, see FIG. 4) corresponding to the sticking out amount of the printing medium P from the tray is calculated. After this, the process goes to step S32 to determine whether end of printing is set. If the end of the printing is not set (NO in step S32), the process returns to step S12 so that the processes after step S12 are repeated.

In addition, if the operations mode switch is designated in step S27 (YES in step S27), the process goes to step S29 so that a chattering eliminating mode is set. If the chattering eliminating mode is set, in step S30, for example, a process for eliminating chattering is performed. For example, the number of detections relative to the detecting signal is increased; the detecting time is delayed; and a threshold is changed.

In step S31, by making the mask distance zero, all of the masking process section (section A) is set to be the non-masking process section. In this case, it is not necessary to perform the masking process on the detecting signal of the conveyance position detecting sensor 250 due to the chattering elimination. Therefore, by setting all of the masking process section (section A) as the non-masking process section, the masking process is not performed for the path from where the head end of the printing medium P travels from the tray sheet feeding opening S0 to the detecting position S2. After this, the process goes to step S32 to determine whether the end of printing is set. In step S32, if the end of printing is not set (NO in step S32), the process returns to the step S12 so that the processes after step S12 are repeated.

Furthermore, in step S32, when the end of printing is set (YES in step S32), the control process is completed.

Here, a process for setting the mask distance performed in step S28 (masking process section setting part) is discussed with reference to a flowchart shown in FIG. 6. In step S51 shown in FIG. 6, the conveyance distance Lx (sticking-out distance of the sheet from the tray) calculated in step S16 is read from the RAM 390.

In step S52, a variable masking distance Lz is calculated by subtracting the conveyance distance Lx and the fixing distance Ly from the distance L between the tray sheet feeding opening S0 and the detecting position S2.

Next, in step S53, the variable masking distance Lz corresponding to the sheet stopping position is set as the masking distance. In step S54, the masking distance obtained by the above-mentioned calculating process (the range corresponding to the variable masking distance Lz) is set as a masking process section at the time of restart after the emergency stop. The non-masking process section is set corresponding to the variable masking distance Lz.

Thus, in this embodiment, when the emergency stop of the conveyance mechanism 600 is made, the masking distance corresponding to the conveyance distance Lx (sheet sticking-out distance from the tray) of the printing medium P is set as the masking process section at the time of restart after the emergency stop, and the non-masking process section is set corresponding to the variable masking distance Lz. Therefore, a section where the head end of the printing medium P is situated from the tray sticking-put position to the masking end position S1 is a masking process section. Even if the emergency stop of the conveyance mechanism 600 is made, the head end of the printing medium P having reached the detecting position S2 where the masking process relative to the detecting signal of the conveyance position detecting sensor 250 is turned off (cancelled) at the time of restart. Hence, it is possible to reliably detect the printing medium P with the conveyance position detecting sensor 250.

Next, a control process of a sheet sticking-out determining process 1 is discussed with reference to FIG. 7. In step S61 shown in FIG. 7, whether the conveyance mechanism 600 stops during the sheet conveyance is determined. In the conveyance mechanism 600, for example, in a case of the sheet jam, a service call (lack of a toner or a sheet), or opening of the side cover of the printer 10, electric power to each of the motors of the conveyance mechanism 600 is blocked so that the emergency stop of the sheet conveyance is made.

In step S61, when the conveyance mechanism 600 stops in emergency during the sheet conveyance (YES in step S61), the process goes to step S62. In step S62, it is set in the RAM 390 that the conveyance mechanism 600 stops in a state where the sheet sticks out from the sheet feeding tray 150 (230). In addition, in step 61, when the conveyance mechanism 600 does not stop in emergency during the sheet conveyance (NO in step S61), the process goes to step S63. In step S63, it is set that the sheet does not stick out from the sheet feeding tray 150 (or 230).

Figure 7:
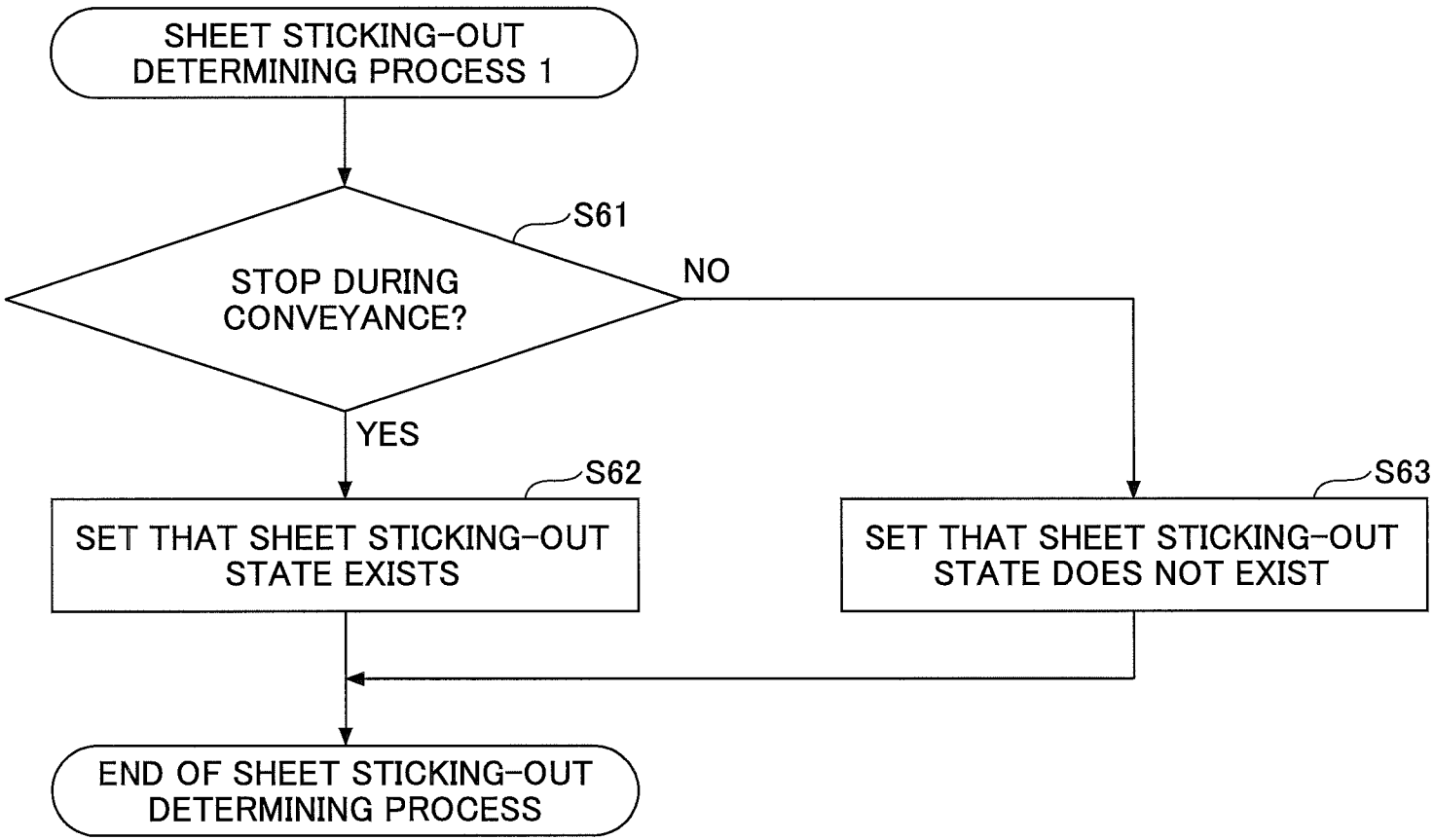
FIG. 7 is a flowchart for explaining a control process of a sheet sticking-out determining process 1.

Thus, in the sheet sticking-out determining process 1 shown in FIG. 7, when the conveyance mechanism 600 stops during the printing, the conveyance mechanism 600 likely stops in a state where the sheet sticks out from the sheet feeding tray 150 (or 230). Because of this, during the printing, it is not necessary to directly detect whether the sheet sticks out. When the conveyance mechanism 600 stops during the printing, it is determined that the sheet sticks out from the sheet feeding tray 150 (or 230) so that the workload of the controller 400 can be reduced.

Figure 8:
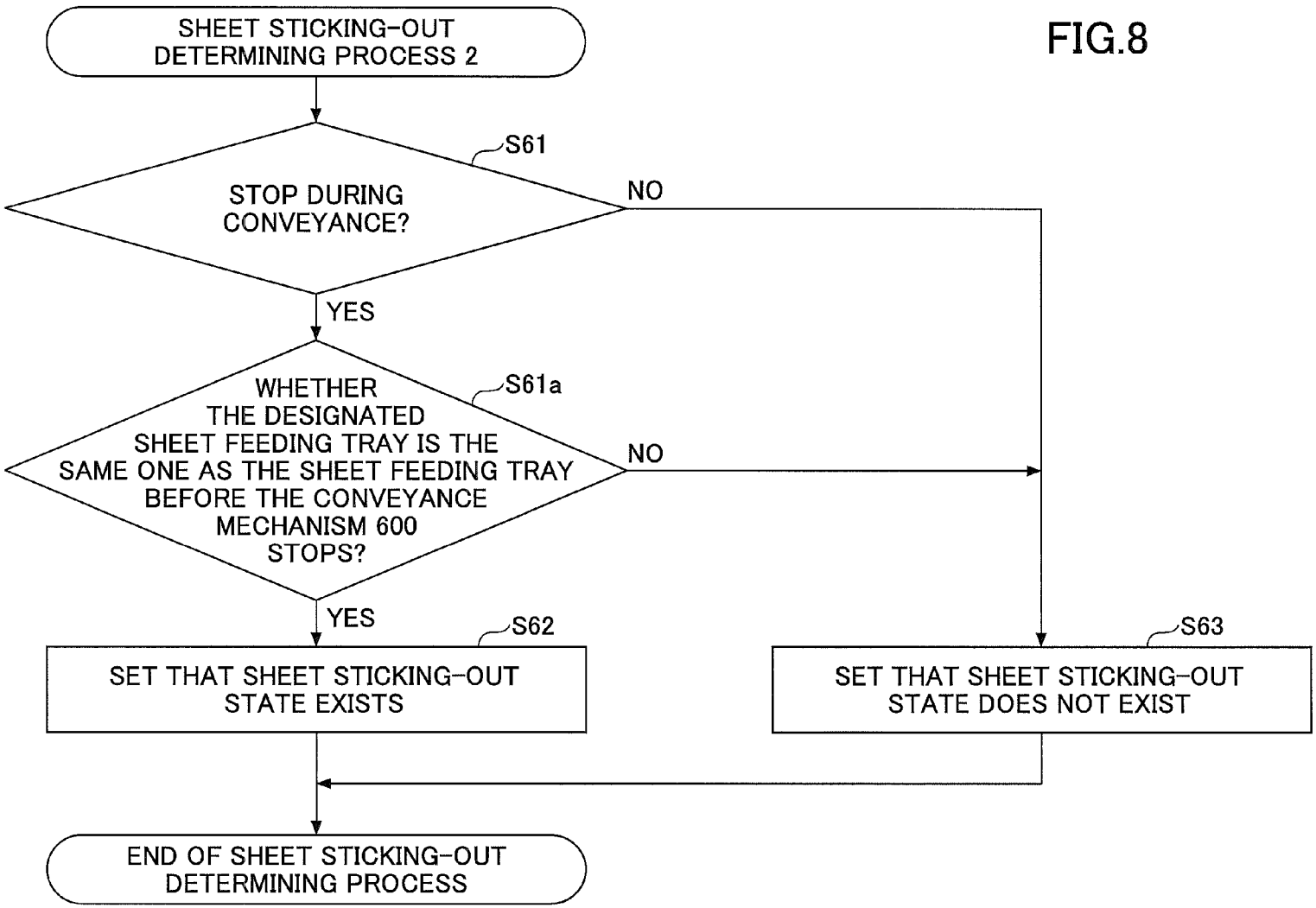
FIG. 8 is a flowchart for explaining a control process of a sheet sticking-out determining process 2.

Next, a sheet sticking-out determining process (control part) 2 is discussed with reference to a flowchart of FIG. 8. In FIG. 8, parts that are the same as the parts shown in FIG. 7 are given the same reference numerals, and explanation thereof is omitted. In step S61 shown in FIG. 8, whether the conveyance mechanism 600 stops during the sheet conveyance is determined. In the conveyance mechanism 600, for example, in a case of the sheet jam, a service call (lack of a toner or a sheet), or opening of the side cover of the printer 10, electric power to each of the motors of the conveyance mechanism 600 is blocked so that the emergency stop of the sheet conveyance is made.

In step S61, when the conveyance mechanism 600 stops in emergency during the sheet conveyance (YES in step S61), the process goes to step S61*a*. In step S61*a*, it is determined whether the designated sheet feeding tray is the same one as the sheet feeding tray before the conveyance mechanism 600 stops (printing medium receiving part identifying part). In step S61*a*, when the designated sheet feeding tray is the same one as the sheet feeding tray before the conveyance mechanism 600 stops (YES in step S61*a*), the process goes to step S62. In step S62, it is set in the RAM 390 that the conveyance mechanism 600 stops in a state where the sheet sticks out from the sheet feeding tray 150 (230). In addition, in step 61, when the conveyance mechanism 600 does not stop in emergency during the sheet conveyance (NO in step S61) or when the designated sheet feeding tray is not the same one as the sheet feeding tray before the conveyance mechanism 600 stops (NO in step S61*a*), the process goes to step S63. In step S63, it is set that the sheet does not stick out from the sheet feeding tray 150 (or 230).

Thus, in the sheet sticking-out determining process 2 shown in FIG. 8, when the conveyance mechanism 600 stops during the printing and when the designated sheet feeding tray is the same one as the sheet feeding tray before the conveyance mechanism 600 stops, the conveyance mechanism 600 likely stops in a state where the sheet sticks out from the sheet feeding tray 150 (or 230). Because of this, during the printing, it is not necessary to directly detect whether the sheet sticks out. When the conveyance mechanism 600 stops during the printing, it is determined that the sheet sticks out from the sheet feeding tray 150 (or 230) so that the workload of the controller 400 can be reduced.

Figure 9:
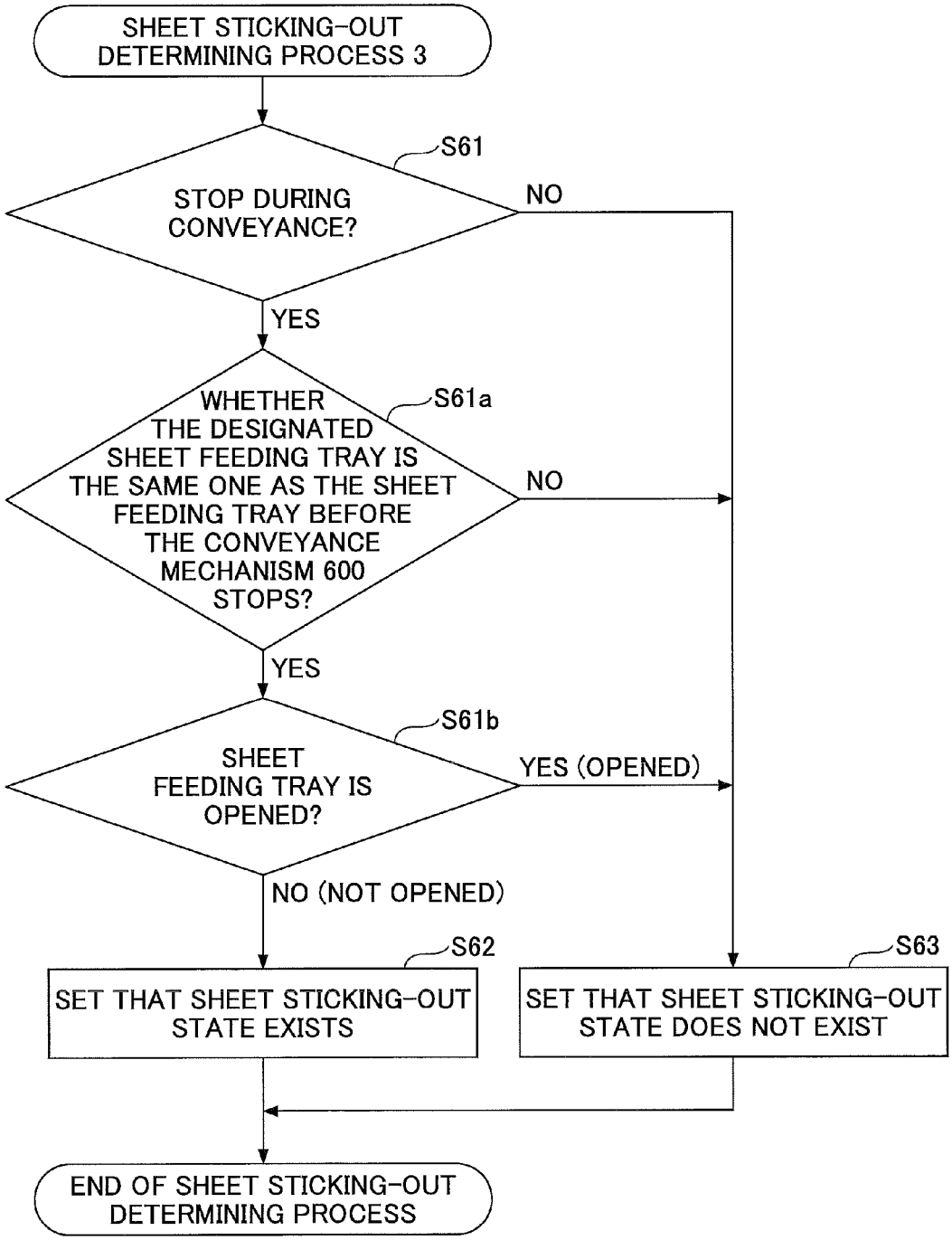
FIG. 9 is a flowchart for explaining a control process of a sheet sticking-out determining process 3.

Next, a sheet sticking-out determining process (control part) 3 is discussed with reference to a flowchart of FIG. 9. In FIG. 9, parts that are the same as the parts shown in FIG. 7 and FIG. 8 are given the same reference numerals, and explanation thereof is omitted. In step S61 shown in FIG. 9, whether the conveyance mechanism 600 stops during the sheet conveyance is determined. In the conveyance mechanism 600, for example, in a case of the sheet jam, a service call (lack of toner or a sheet), or opening of the side cover of the printer 10, electric power to each of the motors of the conveyance mechanism 600 is blocked so that the emergency stop of the sheet conveyance occurs.

In step S61, when the conveyance mechanism 600 stops in emergency during the sheet conveyance (YES in step S61), the process goes to step S61*a*. In step S61*a*, it is determined whether the designated sheet feeding tray is the same one as the sheet feeding tray before the conveyance mechanism 600 stops. In step S61*a*, when the designated sheet feeding tray is the same one as the sheet feeding tray before the conveyance mechanism 600 stops (YES in step S61*a*), the process goes to step S61*b*. In step S61*b*, it is determined whether the sheet feeding tray 150 (or 230) is opened (printing medium receiving part opening determining part). A sensor is provided at an attaching part of each of the sheet feeding trays 150 and 230 so as to detect opening and closing operations of the tray. In the controller 400, opening and closing states and opening and closing operations of each of the sheet feeding trays 150 and 230 can be recognized based on a signal from the corresponding sensor.

In step S61*b*, when a cover of the sheet feeding tray 150 (230) is opened (YES in step S61*b*), the process goes to step S62 so that it is set in the RAM 390 that the conveyance mechanism 600 stops in a state where the sheet sticks out from the sheet feeding tray 150 (230).

In addition, when the conveyance mechanism 600 does not stop in emergency during the sheet conveyance (NO in step S61), when the designated sheet feeding tray is not the same one as the sheet feeding tray before the conveyance mechanism 600 stops (NO in step S61*a*), or when the sheet feeding tray 150 (230) is taken out so that the door is not opened (NO in step S61*b*), the end part of the printing medium P likely returns to the tray and therefore the process goes to step S63. In step S63, it is set that the sheet does not stick out from the sheet feeding tray 150 (or 230).

Thus, according to the masking distance setting processes 1 though 3 performed in step S28, it is possible to determine whether the sheet sticks out from the sheet feeding tray 150 (230).

Accordingly, in the sheet sticking-out determining process 3 shown in FIG. 9, when the conveyance mechanism 600 stops during the printing, when the designated sheet feeding tray is the same one as the sheet feeding tray before the conveyance mechanism 600 stops, and when the cover of the sheet feeding tray 150 (or 230) is opened, the conveyance mechanism 600 likely stops in a state where the sheet sticks out from the sheet feeding tray 150 (or 230). Because of this, during the printing, it is not necessary to directly detect whether the sheet sticks out. Hence, it is possible to determine whether the sheet sticks out from the sheet feeding tray 150 (or 230) so that the workload of the controller 400 can be reduced.

Figure 10A:
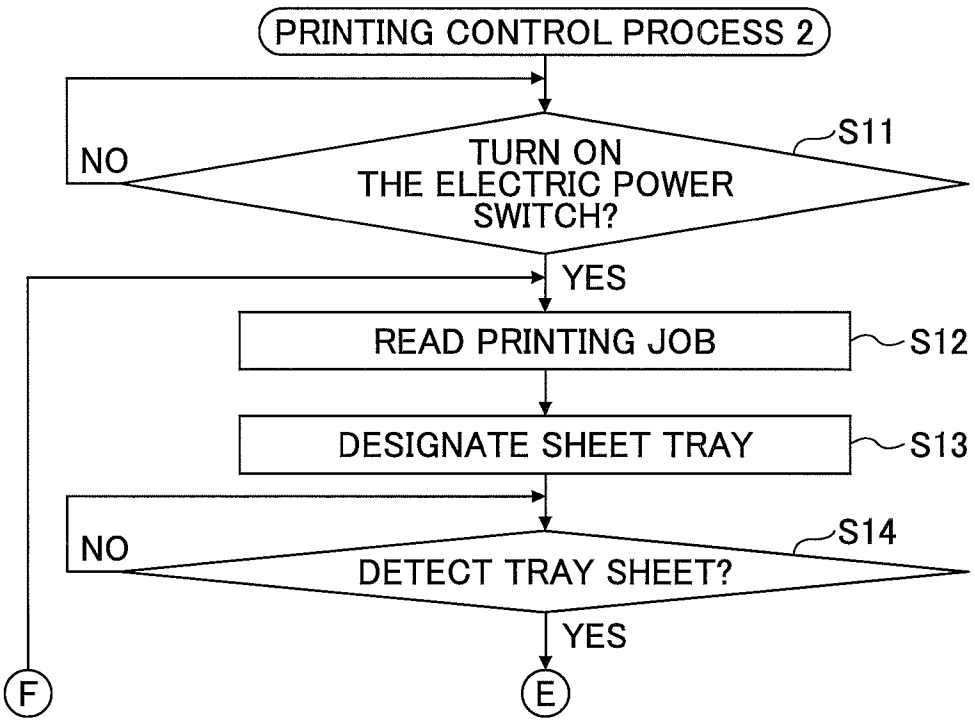
FIG. 10 is a flowchart for explaining a modified example of the main control process performed by a controller 400.
Figure 10B:
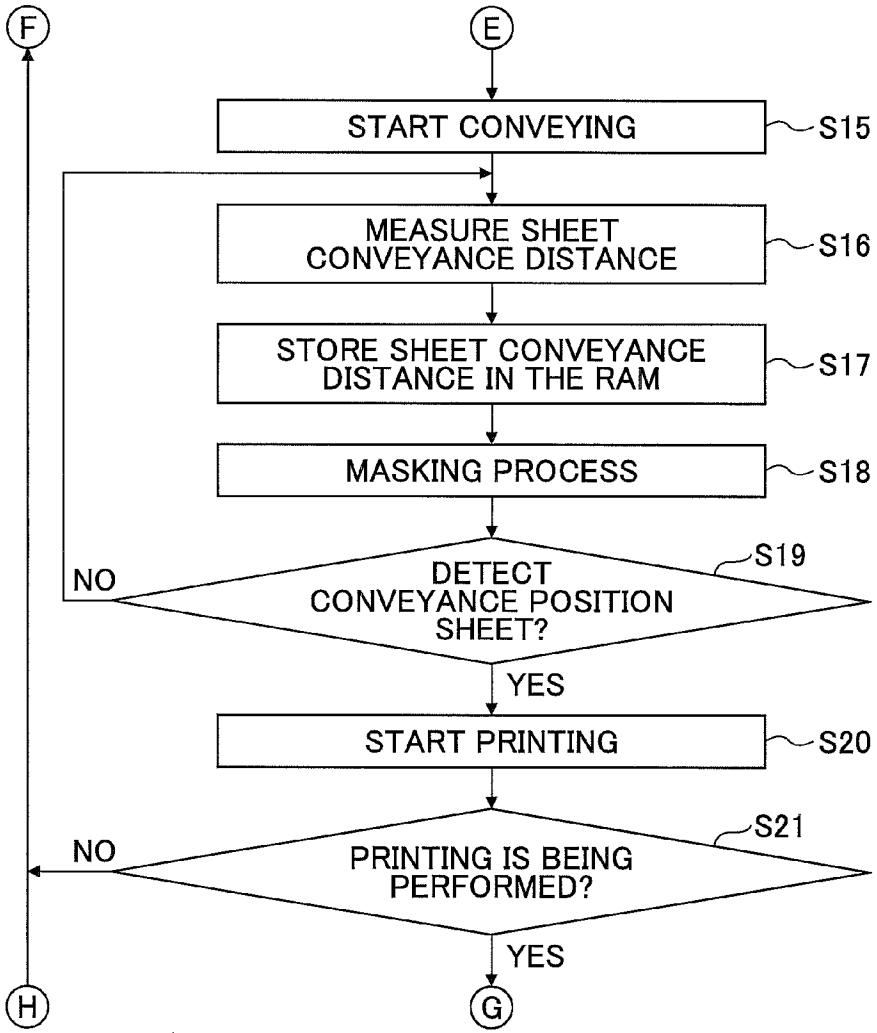
Figure 10C:
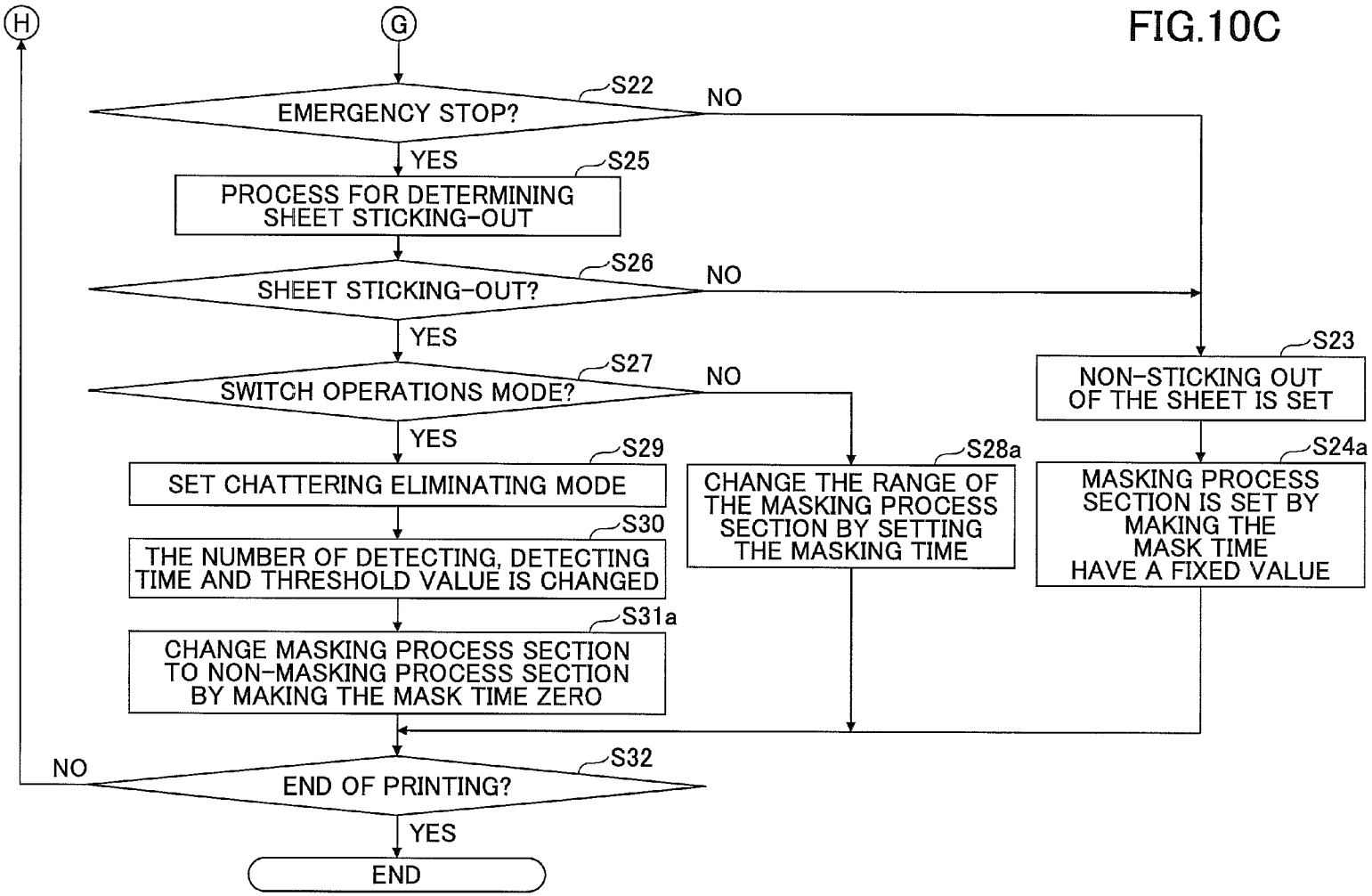

A modified example is discussed with reference to a flowchart shown in FIG. 10. In FIG. 10, parts that are the same as the parts shown in FIG. 5 are given the same reference numerals, and explanation thereof is omitted.

The controller 400 sets the range of the masking process section (section A) by setting the masking time (a time set for performing the masking process) to have a fixed value in step S24*a* shown in FIG. 10. This fixed value is a time (determined depending on the conveyance speed) required while the printing medium P passes through a certain distance L1 (see FIG. 4).

In addition, in step S28*a*, the masking time setting process (see FIG. 11) is performed so that the range of the masking process section (section A) is set. In other words, the masking time depending on the sticking out amount of the printing medium P from the tray is calculated.

In section S31*a*, the masking time is set to be zero so that all of the masking process section (section A) is set to be a non-masking process section.

Thus, in the modified example, by setting the masking time, it is possible to set the masking process section (section A).

Figure 11:
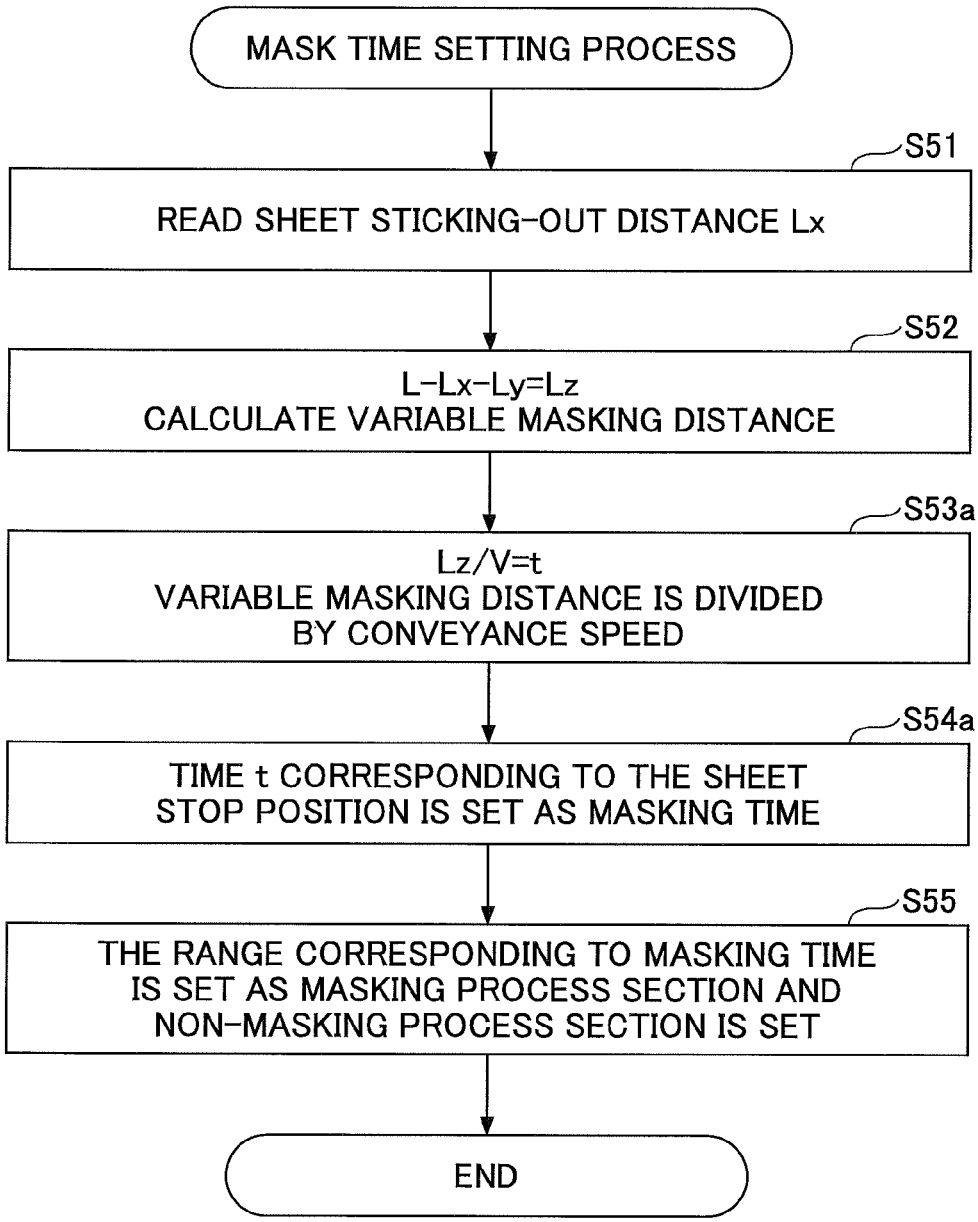
FIG. 11 is a flowchart for explaining a mask time setting process performed in step S28*a*.

Next, the masking time setting process in step S28*a* is discussed with reference to a flowchart shown in FIG. 11. In FIG. 11, parts that are the same as the parts shown in FIG. 6 are given the same reference numerals, and explanation thereof is omitted.

In step S53*a* shown in FIG. 11, the variable masking distance Lz is divided by the conveyance speed V so that a setting time for the masking process is obtained. Then, in step S54*a*, a time t corresponding to a stopping position of the printing medium P is set in the RAM 390 as the masking time.

After that, in step S55, a moving range of the printing medium P corresponding to the masking time is set in the RAM 390 as the masking process section.

Thus, in the modified example, the time t required while the printing medium P is conveyed in the masking process section is set as the masking section so that it is possible to set the masking process section corresponding to the masking time.

In the modified example, by setting the masking process section at the time of restart after the emergency stop based on the masking time corresponding to the conveyance distance Lx of the printing medium P (sheet sticking-out distance from the tray), the distance where the head end of the printing medium P is situated from the tray sticking-out position to the masking end position S1 is the masking process section. Accordingly, even if the conveyance mechanism 600 stops in emergency, the head end of the printing medium P reaches the detecting position S2 where the masking process of the detecting signal of the conveyance position detecting sensor 250 at the time of restart is cancelled. Hence, it is possible to reliably detect the head end of the printing medium P with the conveyance position detecting sensor 250.

In the above-discussed embodiments, a case where color printing is performed by the printer engines 30Y, 30C, 30M, and 30K and the fixing part 200 is explained as an example. However, the present invention can be applied to monochrome printing.

Furthermore, in the above-discussed embodiments, the printer 10 having two sheet feeding trays 150 and 230 is discussed as an example. However, the present invention is not limited to this. For example, the present invention can be applied to a printer or facsimile where three or more sheet feeding trays are provided.

In addition, in the above-discussed embodiments, the conveyance path which is curved in an arc-shaped manner as shown in FIG. 3 is explained. However, the conveyance path of the present invention is not limited to the conveyance path 170 and may be a different type of conveyance path.

Figure 6:
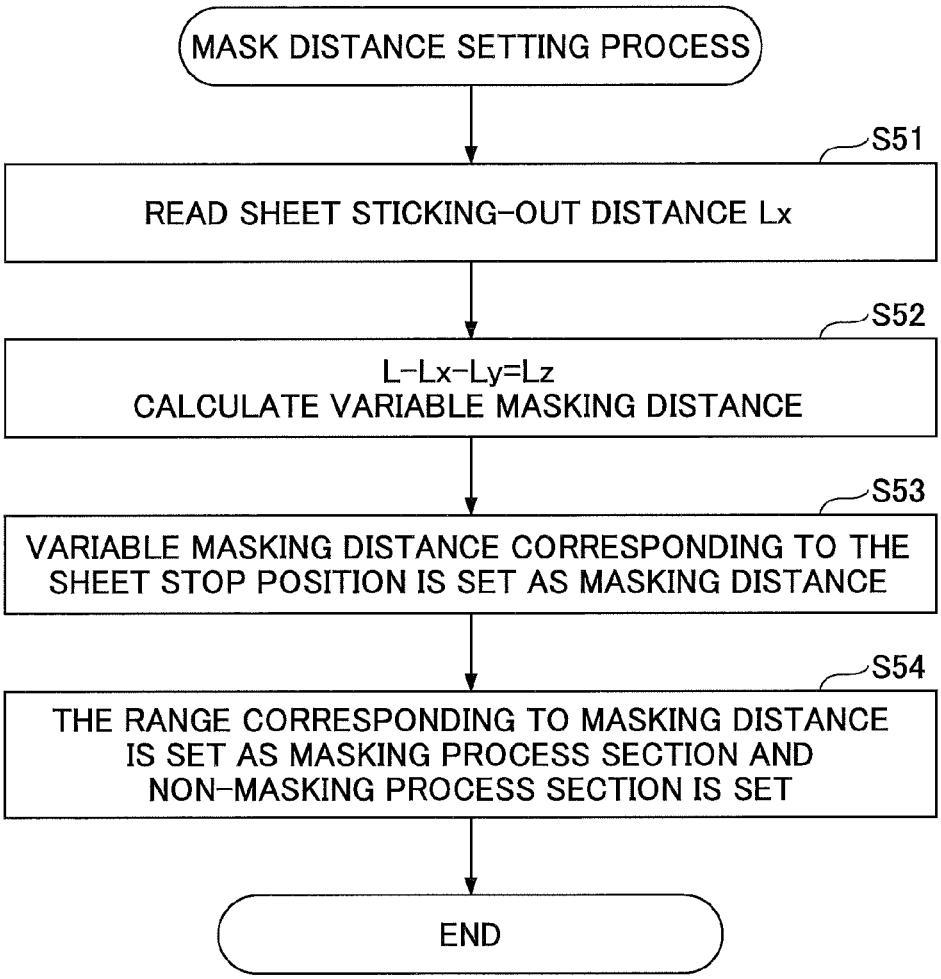
FIG. 6 is a flowchart for explaining a process for setting a mask distance performed in step S28.

Furthermore, in the above-discussed embodiments, in step S54 shown in FIG. 6, the masking process section is based on the variable masking distance Lz at the time of restart and after the emergency stop. The non-masking process section is set based on the variable masking distance (the masking distance means the range corresponding to the variable masking distance Lz). Only one of the masking process section and the non-masking process section may be set.

All examples and conditional language recited herein are intended for pedagogical purposes to aid the reader in understanding the principles of the invention and the concepts contributed by the inventor to furthering the art, and are to be construed as being without limitation to such specifically recited examples and conditions, nor does the organization of such examples in the specification relate to a showing of the superiority or inferiority of the invention. Although the embodiment of the present invention has been described in detail, it should be understood that the various changes, substitutions, and alterations could be made hereto without departing from the spirit and scope of the invention.

What is claimed is:

1. An image forming apparatus, comprising:

a conveyance part configured to convey a printing medium received in a printing medium receiving part along a conveyance path;

a detecting part configured to detect arrival of a head end of the printing medium at a first position of the conveyance path;

a control part configured to print image data on the printing medium based on a detecting signal from the detecting part;

a masking part configured to perform a masking process on the detecting signal generated by the detecting part between when the printing medium starts being conveyed from the printing medium receiving part and when the printing medium passes through a designated section;

a conveyance distance measuring part configured to measure a conveyance distance of the head end of the printing medium conveyed from a receiving position of the printing medium receiving part;

a determining part configured to determine whether the printing medium stops in a second position between the printing medium receiving part and the first position, said second position being not detected by the detecting part when the conveyance part stops while the printing medium is being conveyed by the conveyance part; and a masking process section setting part configured to set, in a case where it is determined by the determining part that the printing medium stops in the second position, a range of a masking process section and/or a range of a non-masking process section in a direction of the conveyance path based on a distance between the second position and the printing medium receiving part, the masking process section being where the masking process of the conveyance path is performed, the non-masking process section being where the masking process is not performed.

2. The image forming apparatus as claimed in claim 1, wherein the masking process section setting part is configured to calculate an uncertain distance Lx from the printing medium receiving part to the second position of the head end of the printing medium measured by the conveyance distance measuring part, to obtain a variable masking distance Lz by subtracting a fixing distance Ly determined by the uncertain distance Lx and the first position from a distance L between the printing medium receiving part and the first position of the detecting part, and to set the range of the masking process section and/or the range of the non-masking process section in a storing part based on the variable masking distance Lz or a setting time calculated by dividing the variable masking distance Lz by a conveyance speed v of the conveyance part.

3. The image forming apparatus as claimed in claim 1, wherein, in a case where a stopping position of the head end of the printing medium measured by the conveyance distance measuring part at the time of the emergency stop is in the printing medium receiving part, the masking process section setting part sets that an uncertain distance Lx from the printing medium receiving part to the second position of the head end of the printing medium measured by the conveyance distance measuring part is zero so as to set the range of the masking process section and/or the range of the non-masking process section in the storing part based on a variable masking distance Lz calculated by subtracting a fixing distance Ly determined by the uncertain distance Lx and the first position from the distance L between the printing medium receiving part and the first position of the detecting part or a setting time calculated by dividing the variable masking distance Lz by the conveyance speed v.

4. The image forming apparatus as claimed in claim 1, wherein the conveyance distance measuring part is configured to calculate the conveyance distance based on a rotating amount and a diameter of a sheet feeding roller being pushed against the printing medium received in the printing medium receiving part.

5. The image forming apparatus as claimed in claim 1, further comprising:

an operations mode switching part configured to switch an operations mode to a mask setting mode by the masking process section setting part or a chattering eliminating mode where noise included in the detecting signal is eliminated in a case where it is determined by the determining part that the printing medium stops in the second position, wherein the range of the masking process section or the range of the non-masking process section is set by the masking process section setting part in a case where the masking setting mode is set by the operations mode switching part, and the masking process section is set as the non-masking process section when the chattering eliminating mode is set.

6. The image forming apparatus as claimed in claim 1, wherein a plurality of the printing medium receiving parts is provided, the image forming apparatus further includes a printing medium receiving part identifying part configured to determine, in a case where the conveyance part stops while the printing medium is being conveyed, whether a printing medium receiving part designated before the stop is the same as a printing medium receiving part designated at the time of restart after the stop, in a case where the printing medium receiving part identifying part determines that the printing medium receiving part designated before the stop is the same as the printing medium receiving part designated at the time of restart after the stop, the range of the masking process section or the range of the non-masking process section is set by the masking process section setting part, and where the printing medium receiving part identifying part determines that the printing medium receiving part designated before the stop is different from the printing medium receiving part designated at the time of restart after the stop, the masking process section is set as the non-masking process section by the masking process section setting part.

7. The image forming apparatus as claimed in claim 1, further comprising:

a recording medium receiving part opening determining part configured to determine whether the printing medium receiving part is opened in a case where the printing medium receiving part identifying part determines that the printing medium receiving part designated before the stop is the same as the printing medium receiving part designated at the time of restart after the stop, wherein in a case where it is determined by the recording medium receiving part opening determining part that the printing medium receiving part is not opened, the masking process section is set as the non-masking process section by the masking process section setting part.

8. A control method of an image forming apparatus, the image forming apparatus including a conveyance part configured to convey a printing medium received in a printing medium receiving part along a conveyance path;

a detecting part configured to detect arrival of a head end of the printing medium at a first position of the conveyance path; and a control part configured to print image data on the printing medium based on a detecting signal from the detecting part;

the control method comprising the steps of:

performing a masking process on the detecting signal generated by the detecting part between when the printing medium starts being conveyed from the printing medium receiving part and when the printing medium passes through a designated section;

measuring a conveyance distance of the head end of the printing medium conveyed from a receiving position of the printing medium receiving part;

determining whether the printing medium stops in a second position between the printing medium receiving part and the first position, said second position being not detected by the detecting part when the conveyance part stops while the printing medium is being conveyed by the conveyance part; and setting, in a case where it is determined by the determining part that the printing medium stops in the second position, a range of a masking process section and/or a range of a non-masking process section in a direction of the conveyance path based on a distance between the second position and the printing medium receiving part, the masking process section being where the masking process of the conveyance path is performed, the non-masking process section being where the masking process is not performed.

9. A printing medium conveyance apparatus, comprising:

a conveyance part configured to convey a printing medium received in a printing medium receiving part along a conveyance path;

a detecting part configured to detect arrival of a head end of the printing medium at a first position of the conveyance path;

a masking part configured to perform a masking process on a detecting signal generated by the detecting part between when the printing medium starts being conveyed from the printing medium receiving part and when the printing medium passes through a designated section;

a conveyance distance measuring part configured to measure a conveyance distance of the head end of the printing medium conveyed from a receiving position of the printing medium receiving part;

a determining part configured to determine whether the printing medium stops in a second position between the printing medium receiving part and the first position, said second position being not detected by the detecting part when the conveyance part stops while the printing medium is being conveyed by the conveyance part; and a masking process section setting part configured to set, in a case where it is determined by the determining part that the printing medium stops in the second position, a range of a masking process section and/or a range of a non-masking process section in a direction of the conveyance path based on a distance between the second position and the printing medium receiving part, the masking process section being where the masking process of the conveyance path is performed, the non-masking process section being where the masking process is not performed.

10. The image forming apparatus as claimed in claim 1, wherein the second position is a position where the printing medium stops in case of emergency stop.

* * * * *